US008066290B2

(12) United States Patent
Kleine et al.

(10) Patent No.: US 8,066,290 B2
(45) Date of Patent: Nov. 29, 2011

(54) CHUCK

(75) Inventors: Werner Kleine, Achim (DE); Werner Britten, Saarbruecken (DE)

(73) Assignee: Hilti Aktiengesellschaft, Schaan (LI)

( * ) Notice: Subject to any disclaimer, the term of this patent is extended or adjusted under 35 U.S.C. 154(b) by 1434 days.

(21) Appl. No.: 11/271,322

(22) Filed: Nov. 10, 2005

(65) Prior Publication Data

US 2006/0103082 A1 May 18, 2006

(30) Foreign Application Priority Data

Nov. 12, 2004 (DE) ..... 10 2004 054 685

(51) Int. Cl.
*B25D 17/08* (2006.01)

(52) U.S. Cl. ..... 279/19.3; 279/19.7

(58) Field of Classification Search ..... 279/19.3, 279/19.7, 19, 19.4, 19.5, 19.6, 75; 408/226, 408/239 R; 175/320
See application file for complete search history.

(56) References Cited

U.S. PATENT DOCUMENTS

| | | | | |
|---|---|---|---|---|
| 3,894,230 | A | 7/1975 | Rorden et al. | |
| 4,107,949 | A * | 8/1978 | Wanner et al. | 464/167 |
| 4,123,074 | A * | 10/1978 | Wanner | 279/19.5 |
| 4,536,109 | A | 8/1985 | Hunger et al. | |
| 4,658,912 | A | 4/1987 | Rohm | |
| 4,690,226 | A * | 9/1987 | Schnizler et al. | 173/128 |
| 5,076,371 | A * | 12/1991 | Obermeier et al. | 173/104 |
| 5,326,199 | A | 7/1994 | Kleine et al. | |
| 5,340,245 | A * | 8/1994 | Bloechle et al. | 408/226 |
| 5,375,950 | A * | 12/1994 | Schulz et al. | 408/226 |
| 5,700,018 | A * | 12/1997 | Bongers-Ambrosius et al. | 279/19.4 |
| 5,704,744 | A | 1/1998 | Kleine et al. | |
| 5,868,209 | A * | 2/1999 | Wierspecker et al. | 173/213 |
| 5,984,596 | A * | 11/1999 | Fehrle et al. | 408/226 |
| 6,089,798 | A * | 7/2000 | Wierspecker et al. | 408/226 |
| 6,543,558 | B1 * | 4/2003 | Hauptmann et al. | 175/320 |
| 7,258,350 | B2 * | 8/2007 | Kleine et al. | 279/19 |
| 2004/0052596 | A1 | 3/2004 | Kleine et al. | |
| 2005/0141972 | A1 * | 6/2005 | Kleine et al. | 408/226 |

FOREIGN PATENT DOCUMENTS

EP 0426287 5/1991

OTHER PUBLICATIONS

European Search Report.

* cited by examiner

*Primary Examiner* — Eric A Gates
(74) *Attorney, Agent, or Firm* — Abelman, Frayne & Schwab

(57) ABSTRACT

A chuck includes a hollow cylindrical sleeve (3) having at least two, opposite, rotation transmitting strip-shaped webs (4*a*, 4*b*) projecting radially inward, and at least one locking member (2) radially displaceable through a radial opening formed in the receiving sleeve, with the receiving side end of the rotation transmitting webs (4*a*, 4*b*) being spaced from a receiving side edge of the radial opening (6) by a distance (X) 1.5 times greater than the guide diameter (D) of the receiving sleeve (3).

2 Claims, 1 Drawing Sheet

CHUCK

BACKGROUND OF INVENTION

1. Field of Invention

The present invention relates to a chuck with a radially displaceable locking member, in particular, for a hammer drill for receiving a percussion drill.

2. Description of Prior Art

Working tools, which are driven by rotary percussion power tools, have a shank that is formlockingly received in a chuck of the power tool for rotation therewith, with a possibility of a limited axial displacement relative thereto. The shank is axially secured in the chuck with a radially displaceable locking member that penetrates into a groove formed in the shank and closed at its power tool side end.

German Publications DE 19724532 and DE 3205063 both disclose a chuck having a hollow cylindrical receiving sleeve having a predetermined guide diameter and a strip-shaped, rotation transmitting web projecting radially inward and having a predetermined web height, and a radially displaceable locking member. The rotation transmitting web extends from the receiving side, up to the receiving side edge of the sleeve opening, through which the locking member is radially displaced, over an axial length that approximately corresponds to the guide diameter of the receiving sleeve.

U.S. Pat. No. 4,107,949 discloses practically standardized shanks and associated chucks, which at present are primarily used worldwide with hammer drill systems. The shanks have a cylindrical guide surface with a guide diameter of 10 mm, locking grooves which are axially closed at their free end surface, and trapezoidal rotation transmitting grooves which are axially open at their free end surfaces. The associated chucks are provided with at least one, radially displaceable, locking member engageable in a locking groove and limiting the axial displacement of the shank, and thereby of the working tool, in the chuck. Two opposite rotation transmitting webs engage in respective rotation transmitting grooves of the shank and transmit a torque over respective tangential contact surfaces. These shanks were originally designed for drill diameters up to 17 mm and are, thus, associated with small low-power hammer drills with a power less than 650 W. With such power tool power-working tool combination wear problems were practically non-existent.

With the increase of power of the hand-held power tools, in particular, of hammer drills, in certain operational modes, high torques are transmitted to a working tool. Meanwhile, the practical application region of the hammer drills has expanded to drill diameters of 30 mm. It has been shown that a drill with a diameter above 17 mm leads to an increase wear and damage of the chuck in particular, to a noticeably high wear of the contact surfaces of the rotation transmitting webs. In particular, with modern, reinforcement-proof hammer drills, increased occurrences of a working tool blocking in a reinforced bore are observed. When the user wants to pull the hammer drill out of the bore, high torques are applied to the working tool, and high jerky tension forces are generated which are transmitted to the working tool by the receiving side edge of the receiving opening for the locking member.

These forces lead to breaking of the receiving sleeve in the vicinity of the receiving side edge when these forces exceed the allowable multi-axes tension.

Accordingly, an object of the present invention is a chuck for powerful hand-held power tool and having a reduced wear and susceptibility to being damaged.

SUMMARY OF THE INVENTION

This and other objects of the present invention, which will become apparent hereinafter, are achieved by providing a chuck having a hollow cylindrical receiving sleeve with a guide diameter and at least two, opposite, rotation transmitting, strip-shaped webs projecting radially inward and having contact surfaces. At least one locking member is radially displaceable through a radial opening formed in the receiving sleeve. A receiving side end of the rotation transmitting webs is spaced from a receiving side edge of the radial opening by a distance 1.5 times greater than the guide diameter.

The critical axial region, which is susceptible to breaking and is subjected to a multi-axes stress condition of up to 45° at the receiving side edge, extends on both sides over a length of approximately a half of the guide diameter. The additional preceding contact lengths of the rotation transmitting webs, which are defined by the guide diameter, provide, because of the limited torsional stiffness of the shank, that at least a substantial part of a torque acts exclusively at the receiving side of the recess.

The above-discussed critical axial region, which is susceptible to mechanical breaking, is subjected to noticeably smaller loads so that at a predetermined fatigue strength limit, it is capable to withstand a high torque, without being noticeably damaged. The additional contact lengths of the rotation transmitting webs, which noticeably increase the overall length of the webs, transmit to the working tool jerky tension loads, which are manually applied by the user through the power tool, simultaneously with a high torque, without breaking the elements of the system.

Advantageously, the length of the rotation transmitting webs amounts at least to a triple of the guide diameter, which provides for a greater contact surface at the same cross-section.

The greater contact surface results, at standard loads, in a smaller surface pressures, whereby wear is substantially reduced. In addition, the smaller surface pressures leads to smaller sliding friction losses of the shank which is received in the receiving sleeve with a possibility of a limited axial movement. Thereby, the transmission of the impact energy to the working tool is improved.

Advantageously, the rotation transmitting webs are spaced from a receiving side end of the receiving sleeve by a distance that amounts at most to a half of the guide diameter. Thereby, axial guide lengths of the receiving sleeve, which are not used for the torque transmission, are reduced, which, in turn, reduces the overall length of the chuck.

Advantageously, a sum of two contact surfaces, which are oriented in a same rotational direction, lies in a range between a half and an integer of a square of the guide diameter, whereby the chuck is dimensioned for surface pressures of 100-120 MPa, which are recommended for steel-on-steel contact systems such as flat keys.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
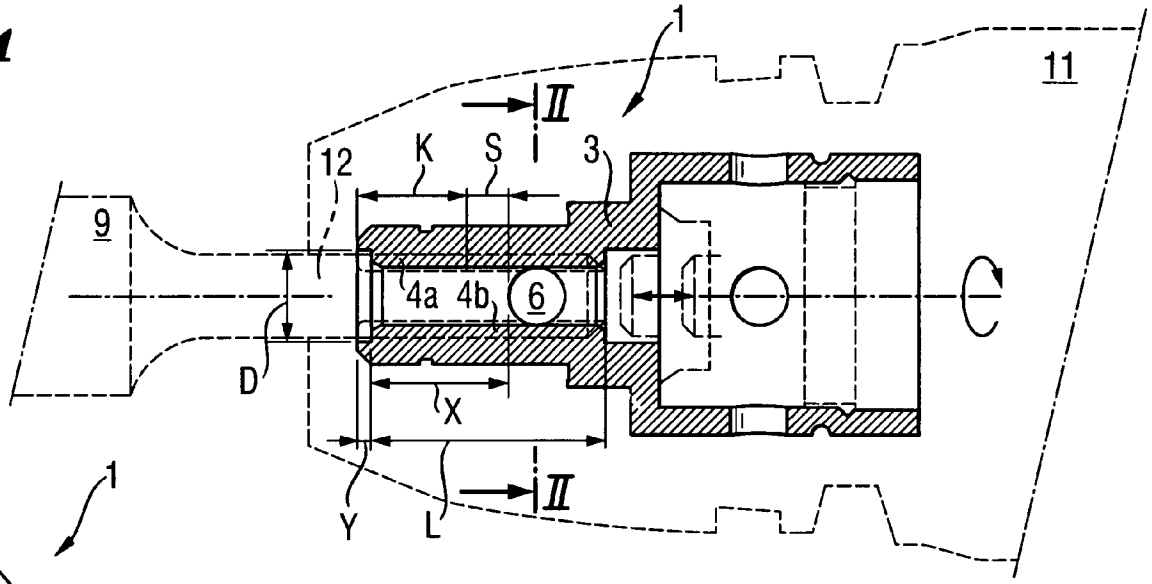
FIG. 1 a longitudinal cross-sectional view of a chuck according to the present invention taken along line I-I in FIG. 2.
Figure 2:
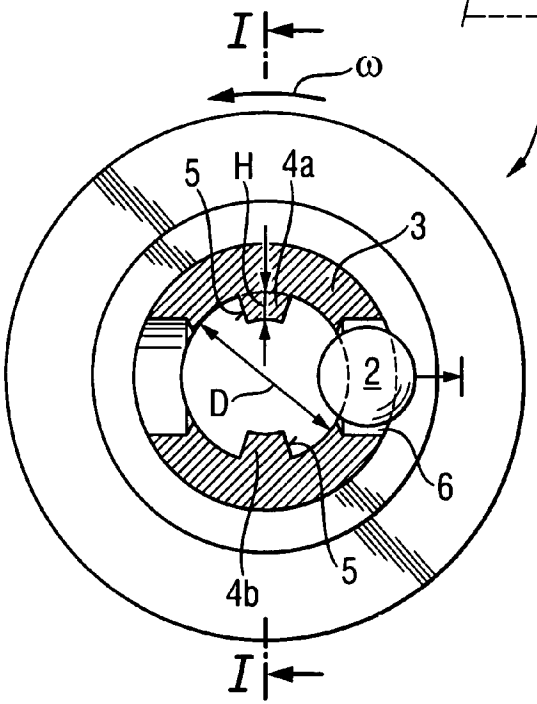
FIG. 2 a cross-sectional view along line II-II in FIG. 1.

A chuck 1 of a rotary-percussion power tool 11 for driving a working tool 9, which is shown in FIGS. 1-2, has two strip-shaped, rotation transmitting webs 4*a*, 4*b* which project radially inward from a hollow cylindrical receiving sleeve 3 having a guide diameter D, and a locking member 2 in form of a ball radially displaceable through an opening 6 provided in the receiving sleeve 3. The rotation transmitting webs 4*a*, 4*b* have a height H−0.15 of the guide diameter D of the receiving sleeve 3 and a length L, and are provided with radially extending contact surfaces 5. The receiving side end of the rotation transmitting webs 4*a*, 4*b* is spaced by a distance X from the receiving side edge of the opening 6. The distance X is approximately equal to a double of the guide diameter D. The length L of the rotation transmitting webs 4*a*, 4*b* amounts to a triple of the guide diameter. The rotation transmitting webs 4*a*, 4*b* are spaced from the receiving side end of the receiving sleeve 3 by a distance Y that amounts to one/fifth of the guide diameter D.

The sum Σ of all of the contact surfaces 5, which are oriented in the same rotational direction ω lies in a range between a half and an integer of a square of the guide diameter D, with Σ=2L, H=2 (3D)(0.15D)=0.9D^2. Even with a powerful power tool 11 with a torque up to 50,000 Nmm, at a guide diameter D=10 mm, there is obtained a surface pressure $$P=M/(DLH)=M/0.45D^{\wedge}=111\ \text{MPa}$$

which remains within recommended limits. At high torques, e.g., when the working tool is blocked, because of the limited torsional stiffness of the shank 12 of the working tool 9, essentially only an additional contact length K=D=10 at the receiving side, which precedes the multi-axial stress condition S, will be stressed.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A chuck, comprising a hollow cylindrical receiving sleeve (3) having a guide diameter (D) and at least two, opposite, rotation transmitting, strip-shaped webs (4*a*, 4*b*) projecting radially inward and having contact surfaces (5); and at least one locking member (2) radially displaceable through a radial opening formed in the receiving sleeve, a receiving side end of the rotation transmitting webs (4*a*, 4*b*) being spaced from a receiving side edge of the radial opening (6) by a distance (X) 1.5 times greater than the guide diameter (D), wherein the sum of contact surfaces (5) of the rotation transmitting webs (4*a*, 4*b*) is determined by an equation:

$$\Sigma=2LH=2(3D)(0.15D)=0.9D^{\wedge}2$$

wherein:

L—is a length of a rotation transmitting web;

H—is a height of the rotation transmitting web; and

D—is the guide diameter of the receiving sleeve.

2. A chuck according to claim 1, wherein the rotation transmitting webs (4*a*, 4*b*) are spaced from a receiving side end of the receiving sleeve (3) by a distance (Y) that amounts at most to a half of the guide diameter (D).

* * * * *